US009118155B2

(12) United States Patent
Tsai

(10) Patent No.: US 9,118,155 B2
(45) Date of Patent: Aug. 25, 2015

(54) THREE-WAY CONNECTOR AND LIGHT STRING USING SAME

(71) Applicant: Chang-Fu Tsai, Taichung (TW)

(72) Inventor: Chang-Fu Tsai, Taichung (TW)

(73) Assignee: Chang Fu Tsai, Taichung (TW)

( * ) Notice: Subject to any disclaimer, the term of this patent is extended or adjusted under 35 U.S.C. 154(b) by 76 days.

(21) Appl. No.: 14/164,202

(22) Filed: Jan. 25, 2014

(65) Prior Publication Data

US 2015/0214682 A1 Jul. 30, 2015

(51) Int. Cl.

| | |
|---|---|
| ***H01R 25/00*** | (2006.01) |
| ***H01R 31/02*** | (2006.01) |
| ***F21V 23/06*** | (2006.01) |
| ***F21S 4/00*** | (2006.01) |

(52) U.S. Cl.

CPC ..... *H01R 25/003* (2013.01); *F21S 4/001* (2013.01); *F21V 23/06* (2013.01); *H01R 31/02* (2013.01)

(58) Field of Classification Search

CPC ..... H01R 25/003; H01R 25/00; H01R 11/32

See application file for complete search history.

(56) References Cited

U.S. PATENT DOCUMENTS

2008/0280470 A1* 11/2008 Byrne ..... 439/215

* cited by examiner

*Primary Examiner* — Mary Ellen Bowman

(74) *Attorney, Agent, or Firm* — Andrew C. Cheng

(57) ABSTRACT

Disclosed are a three-way connector and a light string using the connector. The three-way connector includes first and second three-branched casing members that have joint surfaces respectively comprising mateable recesses and projections and receiving three electrical wires embedded therebetween to form a three-branched connection having a connection point where soldering is applied. Ultrasonic is then applied to fuse and bond the two casing members together as a electrical-wire-included three-branched block thereby constituting a three-way connector. The three-way connector can be used in combination with two-way sockets, electrical wires, and LED luminous elements, in series connection or in parallel connection, to form various configurations of the LED light string.

12 Claims, 5 Drawing Sheets

THREE-WAY CONNECTOR AND LIGHT STRING USING SAME

BACKGROUND OF THE INVENTION

1. Field of the Invention

The present invention relates to a three-way connector and a light string using the three-way connector, and in particular to a modularized three-way connector and an LED light string that comprises the modularized three-way connector, two-way connectors, electrical wires, and LED luminous elements that are connected in series or in parallel to form any desired configuration.

2. the Related Arts

A conventional light string is generally composed of light bulbs, solder, glue, electrical wires, and plastic wrapping films. A portion of the insulation jackets is first stripped to expose of a portion of the conductive core. Terminals of the bulb are attached to the exposed conductive core by applying the solder thereto and is then coated with a layer of the glue for enhancing attachment. Finally, the entire assembly is enclosed by the wrapping film to have a lower portion of the bulb and the electrical wire tightly wrapped and coupled together. Such a light string is generally done with manual assembling.

Manual assembling needs a great amount of human labor and may cause mistaken assembling, leading to low yield rate of the light string. In addition, the parts or assembling process is complicated and this increases the cost and makes the management of manufacturing complicated.

To suit the need for efficient manufacture and assembly with automatic machines, the present applicant has proposed an improved two-way socket for a light string. Such a two-way socket comprises two plastic casing halves. Each of the plastic casing halves has a side forming a half-opening having an inside surface on which an insulation plate is formed. Further, coupling structures are provided on upper and lower ends of each of two sides of the inside surface to allow the two casing halves to couple to each other thereby forming the two-way light string socket. The socket can be combined with electrical wires and an LED luminous element to form the light string. Such a two-way socket and the light string are disclosed in U.S. Pat. No. 8,485,830 and US Patent Publication No. 2013/0182439 A1.

The inventions disclosed in these patents are only applicable to two-way socket and the light string using the socket. In order to suit the need for more diversified arrangements for series connection and/or parallel connection that constitute an LED light string, a connector or socket having a three-way configuration is necessary for use in combination with the above discussed two-way sockets, LED luminous elements, and electrical wires to constitute more diversified LED light strings.

SUMMARY OF THE INVENTION

An object of the present invention is to provide a socket for a three-way connector, which comprises first and second plastic casing members having a three-branch configuration. The two plastic casing members have joint surfaces on which recesses and projections that are engageable with each other are provided and may receive three electrical wires embedded therein to form a three-way connection. The connection point is soldered together. Ultrasonic fusion is then applied to joint the two plastic casing members together to form a wire-included three-branched block whereby modularization of the three-way connector is realized for flexibility of manufacture.

Another object of the present invention is to provide a light string, such as an LED light string, which uses the three-way connector, wherein the three-way connector is used in combination with two-way sockets or connectors, electrical wires, and LED luminous elements (that are attached to the two-way sockets in advance) to constitute, through series connection or parallel connection thereof, various diversified configurations of the LED light string. The assembly is suitable for machine based parts feeding, allowing efficient manufacture and assembly with automatic machines, wherein the assembly is not rely on human labor and achieves an effect of mass production and cost reduction, as well as ensuring high yield rate of the light string.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

A detailed description will be given to discuss the structural features and other advantages and objects of the present invention with reference to the accompanying drawings.

Figure 1:
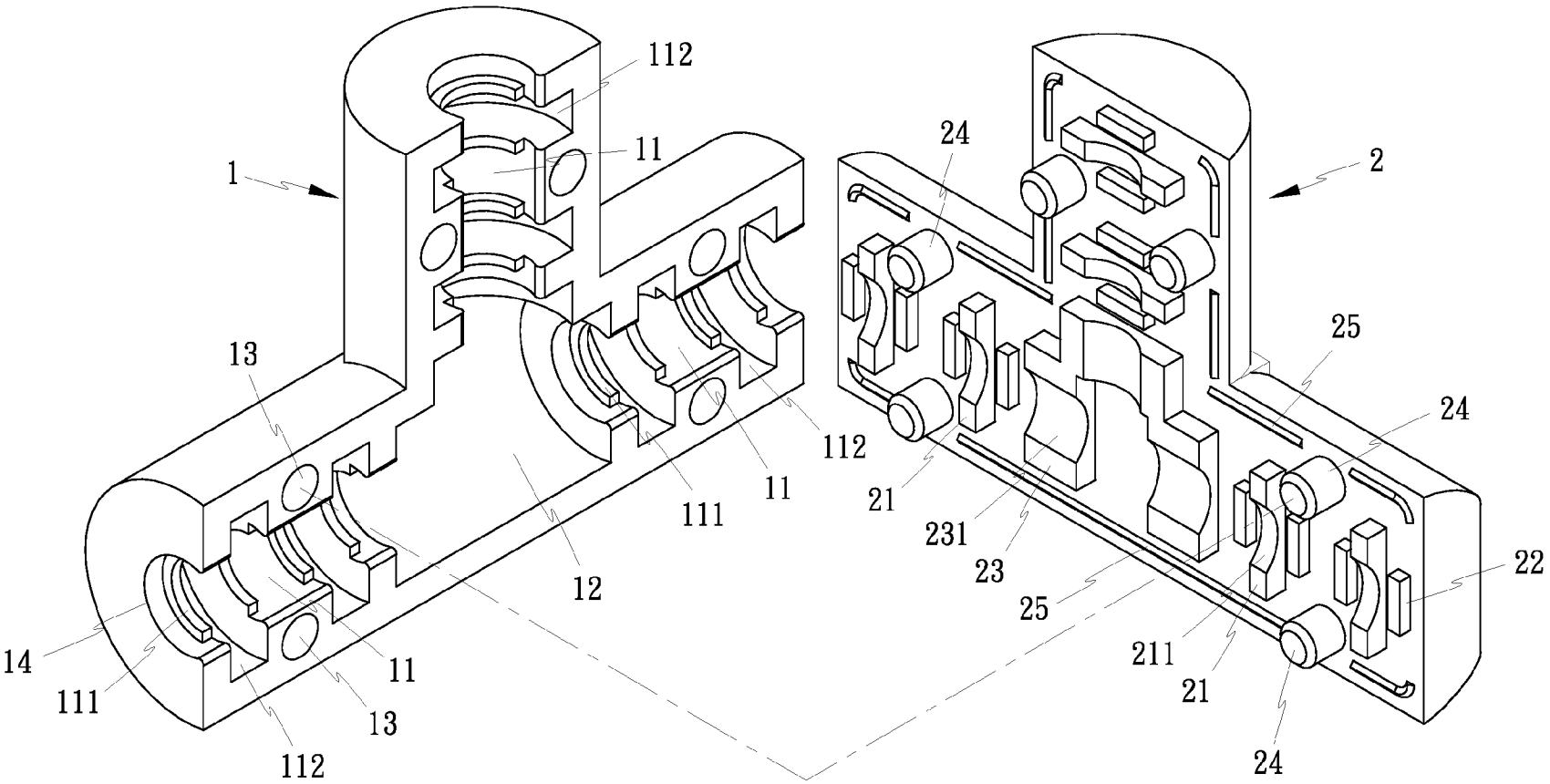
FIG. 1 is an exploded view of a three-way connector according to the present invention.
Figure 3:
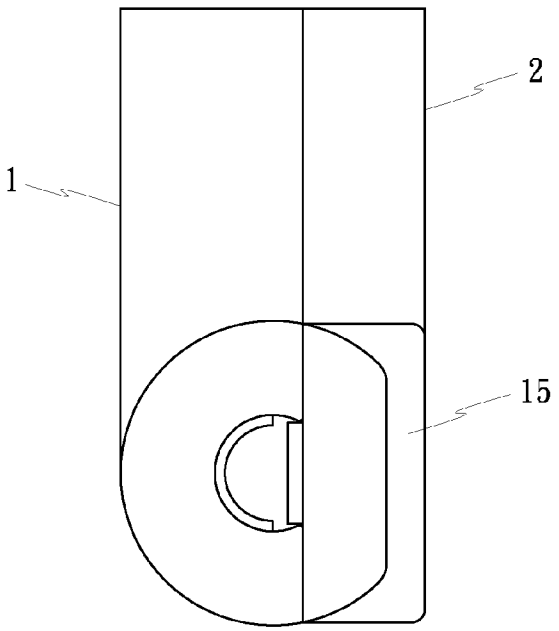
FIG. 3 is a side elevational view, in an assembled form, showing the three-way connector according to the present invention.
Figure 2:
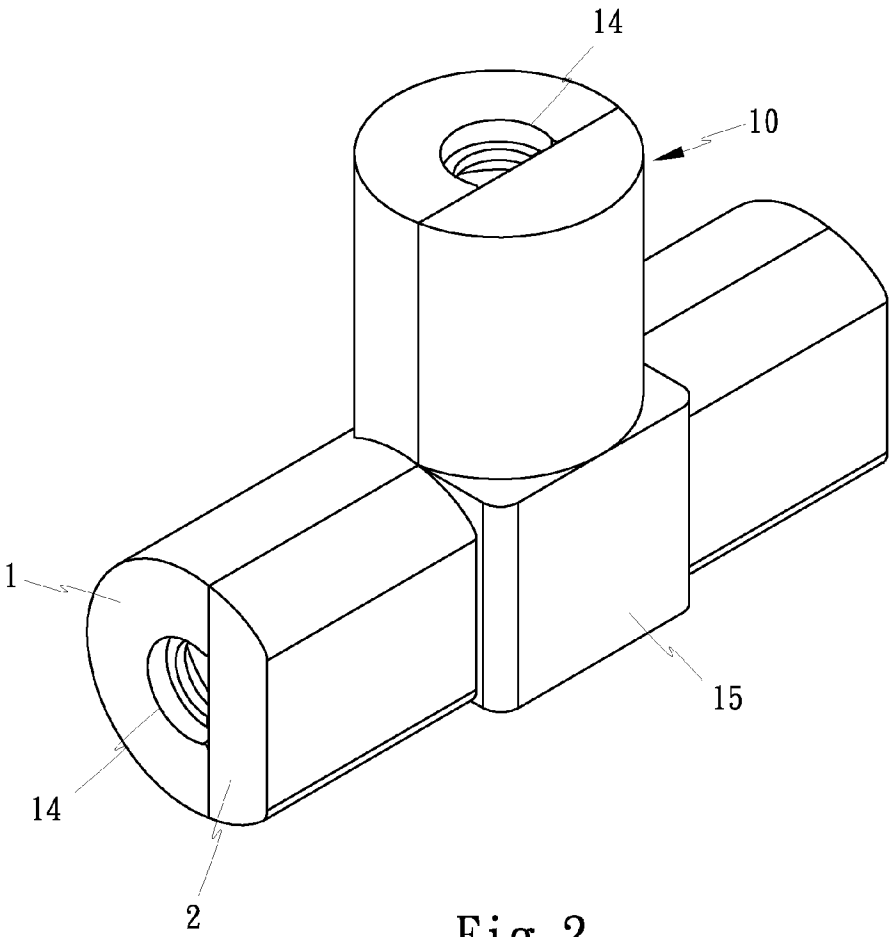
FIG. 2 is a perspective view showing the three-way connector of the present invention in an assembled form.
Figure 4:
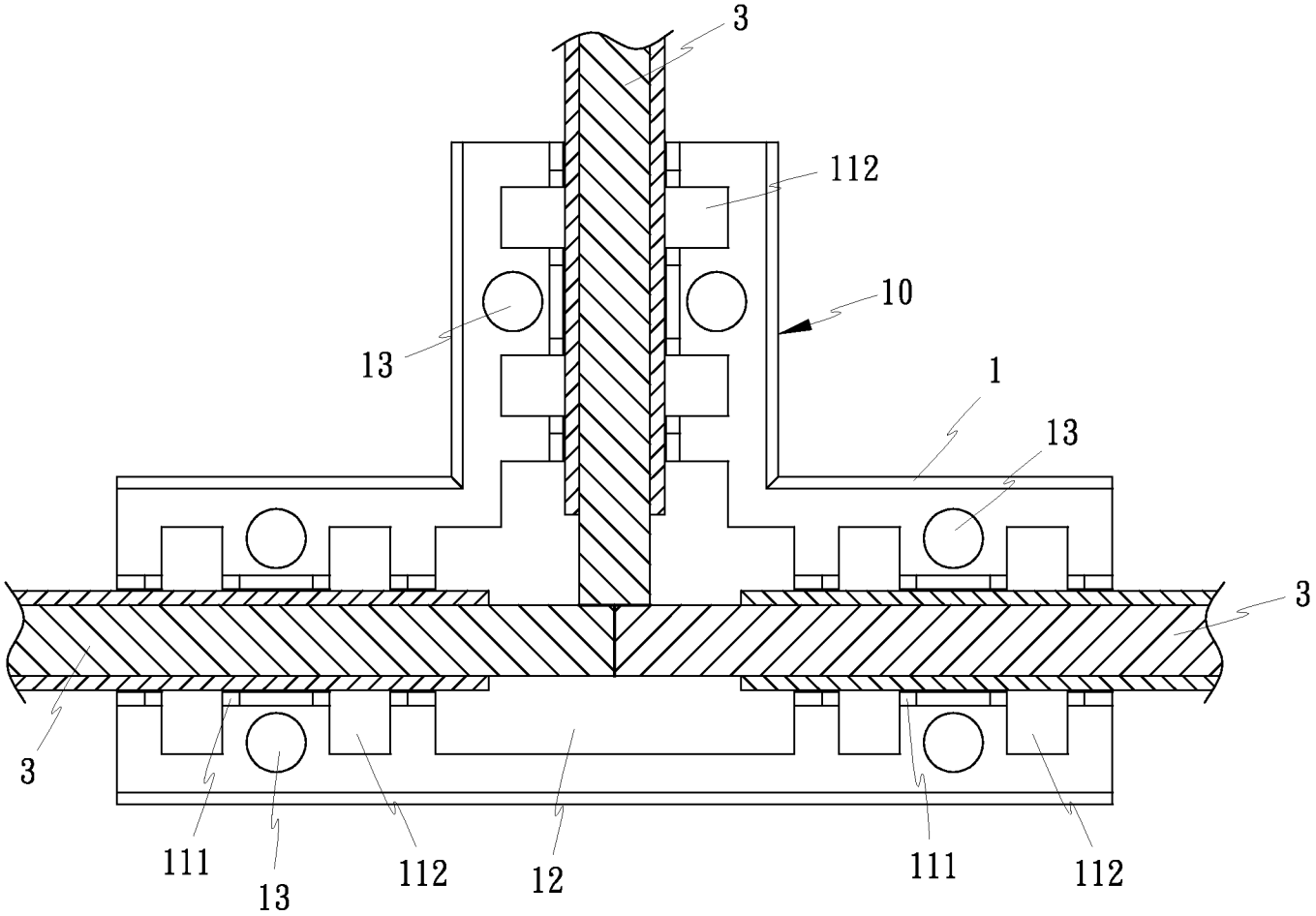
FIG. 4 is a cross-sectional view of the three-way connector according to the present invention in an assembled form.

As shown in the drawings, the present invention provides a three-way connector and a light string using same, of which the three-way connector 10 comprises two three-branched first and second casing members 1, 2, as shown in FIGS. 1-3, wherein:

the first casing member 1 is a semi-body in the form of a three-branched configuration having a joint surface in which a three-passage receiving channel 11 that extends along the three branches is formed and which comprises a central portion in which a connection slot 12 is defined, the joint surface having side edges in which a plurality of jointing recesses 13 is formed;

the second casing member 2 is shaped to mate and correspond to the first casing member 1 in order to be combined together and has a joint surface which comprises a plurality of raised block units arranged thereon in a spaced manner at locations corresponding to the three passages of the three-passage receiving channel 11, each of the raised block units comprising a middle long block 21 and two side short blocks 22; a symmetric triple-connected block 23 arranged at a location corresponding to the connection slot 12, the middle long blocks 21 and the triple-connected block 23 being each comprising a notch 211, 231 formed therein; and a plurality of projections 24 formed at locations corresponding to and engageable with the plurality of recesses 13, fusion ribs 25 being formed along side edges of the joint surface;

The three-branched first and second casing members 1, 2 are jointed to each other to form the three-way connector 10 (see FIG. 2 or 3). However, before jointing, three electrical wires 3 are embedded therein in such a way that a three-branched connection (see FIG. 4) is formed. Soldering may be applied at the connection point to joint them together. Ultrasonic fusion is applied to securely fix the first and second casing members 1, 2 together to form a three-branched block containing therein three electrical wires 3. As such, modularization of the three-way connector is realized for flexibility of manufacture and for applications in assembling of a light string.

In the first casing member 1, the three-passage receiving channel 11 has a cross-sectional configuration (or viewed from an end thereof) that defines a C-shaped clip opening 14. On an inside surface of the three-passage receiving channel 11, a plurality of arc ribs 111 is formed. The arc ribs 111 can press and hold insulation jackets of the embedded electrical wires 3 in order to improve resistance of the electrical wires against outward pulling.

Similarly, in the second casing member 2, the notches 211, 231 of the middle long block 21 and the triple-connected block 23 also compress and hold the insulation jackets of the electrical wires 3 when the first and second casing members 1, 2 are jointed to each other.

In the three-passage receiving channel 11 of the second casing member 2, a plurality of suitably-spaced concave curved grooves 112 that corresponds to and mate the middle long blocks 21 of the raised block units of the second casing member 2 and to collaborate with the arc ribs 111 for compressing and holding so as to provided a tooth-biting like fixing effect to the insulation jackets of the three electrical wires 3, whereby the electrical wires 3 may get partly inlaid in the concave curved grooves 112 and a tortuous configuration is formed to achieve securely fixing of the electrical wires 3 without unexpected separation.

The second casing member 2 comprises a plurality of fusion ribs 25 formed on side edges of the joint surface thereof to provide excellent bonding through thermal fusion by application of an ultrasonic operation. If desired, the fusion ribs 25 may be replaced by tiny raised beads that provide the same effect of thermal fusion and bonding.

As shown in FIGS. 2 and 3, the first casing member 1 is preferably provided on an exposed wall surface thereof with a rectangular block 15 to facilitate picking up by the automatic machines.

Figure 5:
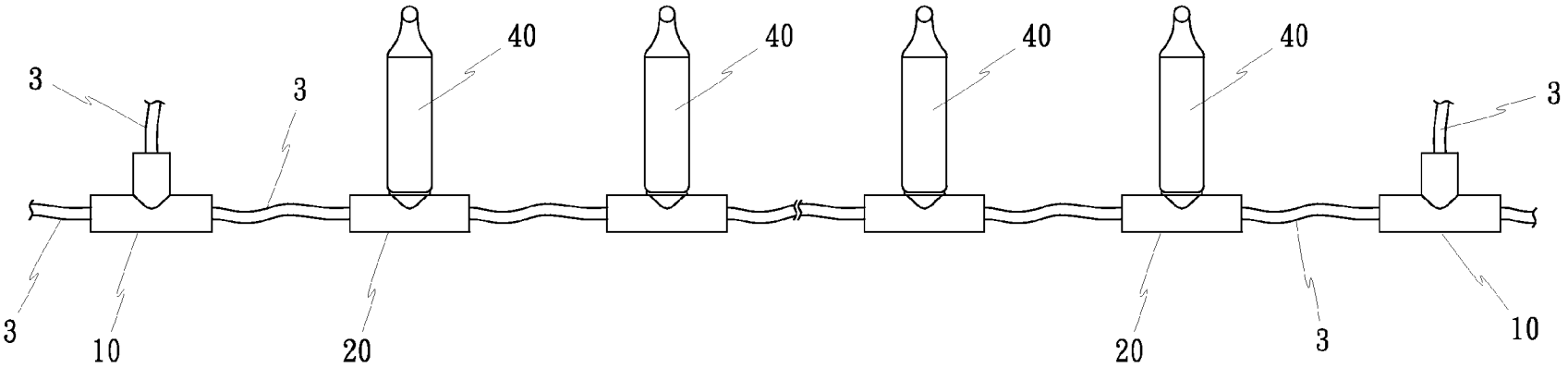
FIG. 5 is a schematic view showing an arrangement of an LED light string according to the present invention that is formed by connecting, in series, three-way connectors with two-way sockets, electrical wires, and LED luminous elements.

As shown in FIG. 5, the three-way connector 10 of the present invention can be used in combination with two-way sockets 20, electrical wires 3, and LED luminous elements 40 (that are attached to the two-way sockets 20 in advance) in series connection to form an LED light string. The two-way sockets 20 are provided, in advance, with the LED luminous elements 40 attached and fixed thereto, thereby each constituting a modularized two-way socket 20 with an LED luminous element 40 included therein, which, according to the specification requirement for the light string, can be connected by the electrical wires 3 in series to form a desired LED light string.

The two-way sockets 20 discussed above can be for example a two-way socket obtained from U.S. Pat. No. 8,485,830, which is owned by the present applicant and the three-way connector 10 of the present invention can be used to connect the LED luminous elements and the electrical wires to collaboratively form various diversified configurations of LED light string. However, if necessary, the use and application of the three-way connector 10, as well as associated assembly thereof, should not be limited to use with the two-way sockets discussed in the previous patent owned by the present applicant.

Figure 6:
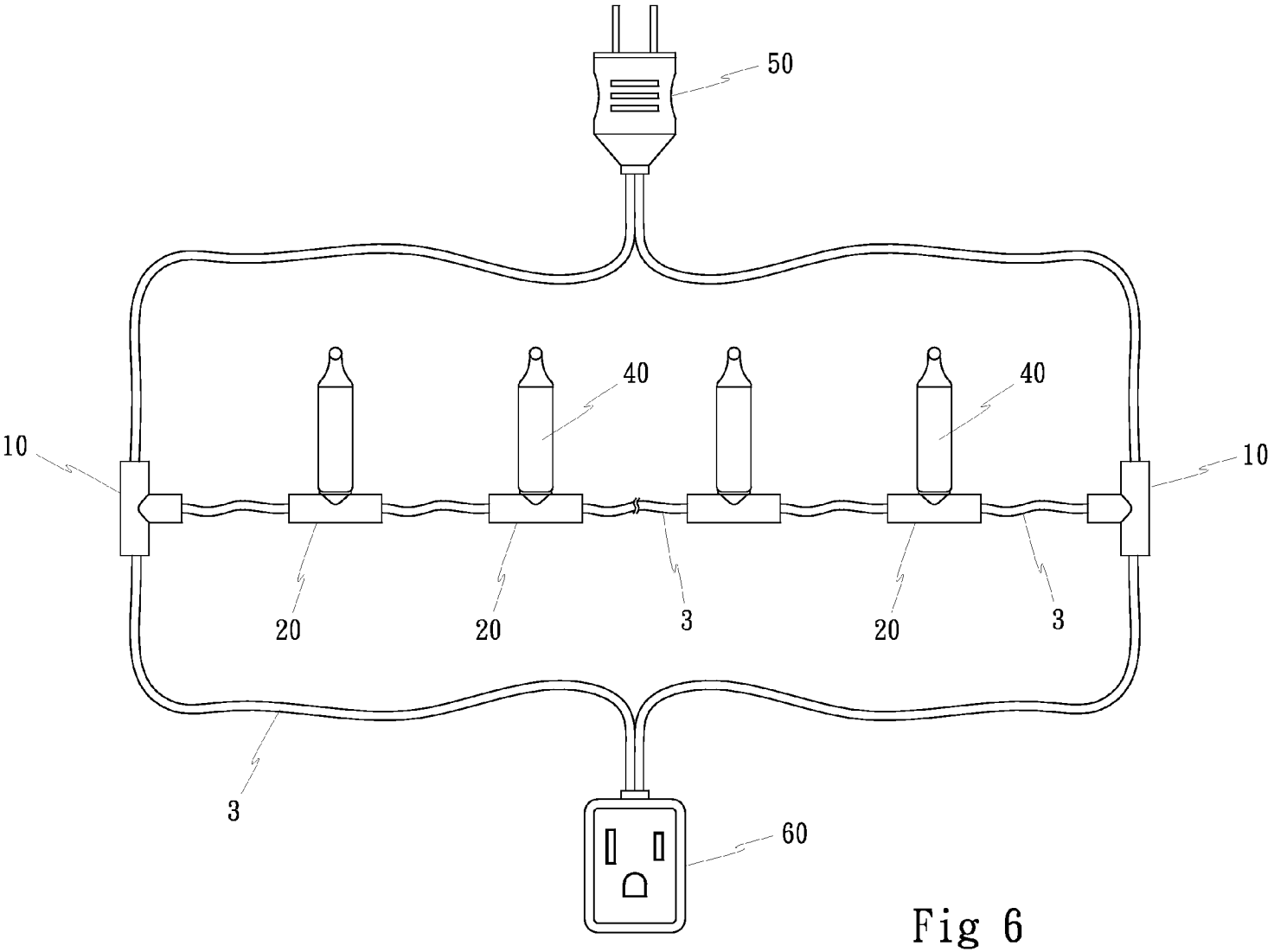
FIG. 6 is a schematic view showing an arrangement of an LED light string according to the present invention that is formed by connecting, in parallel, three-way connectors with two-way sockets, electrical wires, and LED luminous elements.

Similarly, as shown in FIG. 6, the three-way connector 10 of the present invention can be used in combination with two-way sockets 20, electrical wires 3, and LED luminous elements 40 (that are attached to the two-way sockets 20 in advance) in parallel connection to form an LED light string capable of various diversified configurations, wherein two ends of the three-way connector 10 are connected by the electrical wires 3 to a plug 50 or a socket 60 so that a number of such LED light strings can be connected in cascade to provide various and more diversified arrangements of the LED light string.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A three-way connector, which comprises a first and a second three-branched casing members and is characterized in that:

the first casing member is a semi-body in the form of a three-branched configuration having a joint surface in which a three-passage receiving channel that extends along the three branches is formed and which comprises a central portion in which a connection slot is defined, the joint surface having side edges in which a plurality of jointing recesses is formed; and the second casing member is shaped to mate and correspond to the first casing member in order to be combined together and has a joint surface which comprises a plurality of raised block units arranged thereon in a spaced manner at locations corresponding to the three passages of the three-passage receiving channel and a plurality of projections formed at locations corresponding to and engageable with the plurality of recesses;

wherein the three-branched first and second casing members are jointed to each other to form the three-way connector and three electrical wires are embedded therein in such a way that a three-branched connection is formed, ultrasonic fusion being applied to securely fix the first and second casing members together to form a three-branched block containing therein three electrical wires, whereby modularization of the three-way connector is realized.

2. The three-way connector as claimed in claim 1, wherein each of the raised block units of the second casing member comprises a middle long block and two side short blocks.

3. The three-way connector as claimed in claim 1, wherein the second casing member comprises a symmetric triple-connected block formed at a location corresponding to the connection slot of the first casing member.

4. The three-way connector as claimed in claim 2, wherein the middle long blocks each comprises a notch formed therein.

5. The three-way connector as claimed in claim 3, wherein the triple-connected block comprises notches formed therein.

6. The three-way connector as claimed in claim 1, wherein the second casing member comprises a plurality of fusion ribs formed on side edges of the joint surface thereof.

7. The three-way connector as claimed in claim 1, wherein the three electrical wires are soldered together at a connection point thereof.

8. The three-way connector as claimed in claim 1, wherein the first casing member comprises a plurality of arc ribs formed on an inside surface of the three-passage receiving channel.

9. The three-way connector as claimed in claim 1, wherein the second casing member comprises a plurality of spaced concave curved grooves formed in the three-passage receiving channel.

10. The three-way connector as claimed in claim 1, wherein the first casing member comprises a rectangular block formed on an exposed surface thereof.

11. An LED (Light-Emitting Diode) light string using the three-way connector claimed in claim 1, wherein the three-way connector is used in combination with a two-way socket, electrical wires, and an LED luminous element in series connection to form the LED light string, the two-way socket being structured to receive the LED luminous element to attach thereto in advance and being connected by the electrical wires in series connection to form the LED light string.

12. The LED light string as claimed in claim 11, wherein the three-way connector has two ends that are connected by electrical wires to a plug or a socket.

* * * * *